US008845144B1

(12) United States Patent
Davis et al.

(10) Patent No.: US 8,845,144 B1
(45) Date of Patent: Sep. 30, 2014

(54) LIGHT-EMITTING DIODE DRIVER CASE

(75) Inventors: Jared Davis, Newnan, GA (US); Kevin Roy Harpenau, Peachtree City, GA (US); Jyoti Kathawate, Smyrna, GA (US); Michael Troy Winslett, Fairburn, GA (US); Russell Bryant Green, Douglasville, GA (US)

(73) Assignee: Cooper Technologies Company, Houston, TX (US)

( * ) Notice: Subject to any disclaimer, the term of this patent is extended or adjusted under 35 U.S.C. 154(b) by 244 days.

(21) Appl. No.: 13/463,107

(22) Filed: May 3, 2012

Related U.S. Application Data

(60) Provisional application No. 61/588,537, filed on Jan. 19, 2012.

(51) Int. Cl.
*F21V 17/00* (2006.01)

(52) U.S. Cl.
USPC ..... 362/364; 362/365; 362/368; 362/647; 362/652

(58) Field of Classification Search
USPC ..... 362/647, 651, 652, 362–370
See application file for complete search history.

(56) References Cited

U.S. PATENT DOCUMENTS

| | | | | |
|---|---|---|---|---|
| 4,055,874 | A | 11/1977 | Brown | |
| 4,332,060 | A | 6/1982 | Sato | |
| 5,584,575 | A * | 12/1996 | Fickel | 362/364 |
| 5,619,789 | A | 4/1997 | Chung | |
| 7,018,070 | B2 * | 3/2006 | McCoy | 362/260 |
| 7,120,969 | B2 | 10/2006 | Carls | |
| 7,487,584 | B1 | 2/2009 | Lee | |
| 7,959,332 | B2 * | 6/2011 | Tickner et al. | 362/373 |
| 8,215,805 | B2 * | 7/2012 | Cogliano et al. | 362/366 |
| 8,348,477 | B2 * | 1/2013 | Tickner et al. | 362/365 |
| 8,405,947 | B1 * | 3/2013 | Green et al. | 361/103 |
| 8,491,166 | B2 * | 7/2013 | Thompson, III | 362/373 |

* cited by examiner

*Primary Examiner* — John A Ward
(74) *Attorney, Agent, or Firm* — King & Spalding LLP

(57) ABSTRACT

A light emitting diode (LED) driver case includes a housing, driver circuitry, an recessed area in the housing, and a luminaire disconnect. The luminaire disconnect is coupled to the recessed area in the housing and extends toward an aperture in a top plate of a LED module. The luminaire disconnect can be fixedly or removably coupled to the recessed area in the housing. When the luminaire disconnect is removably coupled to the recessed area, one or more of a number of retaining features can be used to prevent the luminaire disconnect from moving or to limit the movement of the luminaire disconnect.

20 Claims, 8 Drawing Sheets

LIGHT-EMITTING DIODE DRIVER CASE

CROSS-REFERENCE TO RELATED APPLICATIONS

This application claims priority under 35 U.S.C. §119 to U.S. Provisional Patent Application Ser. No. 61/588,537, titled "LED-Based Lighting System" and filed on Jan. 19, 2012, the entire contents of which are hereby incorporated herein by reference.

TECHNICAL FIELD

The present disclosure relates generally to a light-emitting diode (LED) driver case, and more particularly, to a LED driver case with an aperture that receives a luminaire disconnect.

BACKGROUND

Recessed lighting is used in a number of different applications. In a number of cases, recessed lighting uses LED technology to provide one or more of a number of benefits, including but not limited to decreased energy consumption, reduced maintenance, and increased efficacy. LED technologies used with recessed lighting involve relatively confined spaces, and so connecting power and/or control wires to one or more components of a LED lighting device can be difficult.

In addition, LED lighting devices can generate heat energy. As a result, heat dissipation devices must be integrated with the design of a LED lighting device. Thus, in addition to space constraints, electrical connections to a LED lighting device may also involve considerations for excessive heat, which can cause decreased reliability and efficiency in the operation of the LED lighting device.

SUMMARY

In general, in one aspect, the disclosure relates to a light-emitting diode (LED) driver case. The LED driver case can include a housing that includes a base member and at least one wall defining a cavity. The LED driver case can also include LED driver circuitry positioned within the cavity of the housing. The LED driver case can further include a recessed area formed within the at least one wall of the housing. The LED driver case can also include a luminaire disconnect slidably coupled to the recessed area and electrically coupled to the LED driver circuitry. The luminaire disconnect can include a non-conductive outer housing and at least one conductive electrical contact disposed at least partially within the non-conductive housing.

In another aspect, the disclosure can generally relate to a light-emitting diode (LED) driver case. The LED driver case can include a housing having a base member and at least one wall defining a cavity. The LED driver case can also include LED driver circuitry positioned within the cavity of the housing. The LED driver case can further include a protrusion disposed upon the at least one wall of the housing. The LED driver case can also include a luminaire disconnect slidably coupled to the protrusion and electrically coupled to the LED driver circuitry. The luminaire disconnect can include a non-conductive outer housing and at least one conductive electrical contact disposed at least partially within the non-conductive housing.

In yet another aspect, the disclosure can generally relate to a light-emitting diode (LED) driver case. The LED driver case can include a housing. The housing can include a base member and at least one vertical wall coupled to the base member. The housing can also include a top member having a top surface and an opposing bottom surface, the top member being removably coupled to the at least one vertical wall, where the base member, the at least one vertical wall, and the top member define a cavity. The LED driver case can also include a LED driver disposed within the cavity of the housing. The LED driver case can further include an aperture disposed through the top plate member. The LED driver case can also include a disconnect mount coupled to the bottom surface of the top member and having a receiving aperture having a first dimension. The LED driver case can further include a luminaire disconnect slidably coupled to the disconnect mount and disposed at least partially through the receiving aperture. The luminaire disconnect can include a non-conductive outer housing have a first lateral dimension and a second lateral dimension greater than the first lateral dimension. The luminaire disconnect can also include at least one conductive electrical contact disposed at least partially within the non-conductive outer housing. In addition, the first dimension of the receiving aperture is greater than the first lateral dimension but less than the second lateral dimension, and the receiving aperture slidably receives a portion of the luminaire disconnect.

In yet another aspect, the disclosure can generally relate to a luminaire. The luminaire can include a light emitting diode (LED) module. The LED module can include an exterior wall having an inner surface and an opposing outer surface. The LED module can also include a base member disposed upon and extending between the inner surface of the exterior wall and having a top surface and an opposing bottom surface. The LED module can further include a first cavity defined by the exterior wall and the top surface of the base member. The LED module can also include a second cavity defined by the exterior wall and the bottom surface of the base member. The LED module can further include a top wall member removably coupled to the exterior wall and enclosing at least a portion of the first cavity. The luminaire can also include a LED driver disposed within the first cavity. The luminaire can further include at least one LED disposed within the second cavity, thermally coupled to the bottom surface of the base member, and electrically coupled to the LED driver. The luminaire can also include a recessed housing formed within at least one of the walls of the LED module. The luminaire can further include a luminaire disconnect slidably coupled to the recessed housing and electrically coupled to the LED driver. The luminaire disconnect can include a non-conductive outer housing, and at least one conductive electrical contact disposed at least partially within the non-conductive housing.

These and other aspects, objects, features, and embodiments will be apparent from the following description and the appended claims.

BRIEF DESCRIPTION OF THE DRAWINGS

The drawings illustrate only exemplary embodiments of LED driver cases and are therefore not to be considered limiting of its scope, as the LED driver cases may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION OF EXEMPLARY EMBODIMENTS

Figure 1A:
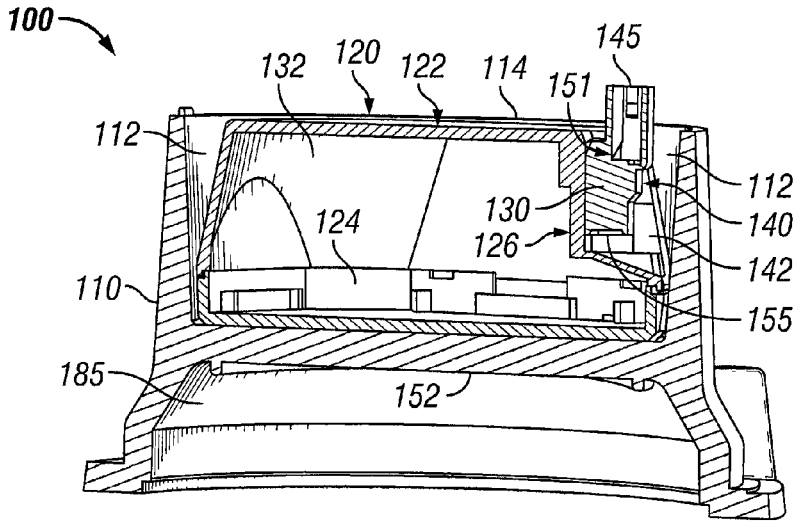
FIG. 1A shows a cross-sectional side view of a LED-based lighting system in accordance with one or more exemplary embodiments.

Exemplary embodiments of LED driver cases will now be described in detail with reference to the accompanying figures. Like, but not necessarily the same or identical, elements in the various figures are denoted by like reference numerals for consistency. In the following detailed description of the exemplary embodiments, numerous specific details are set forth in order to provide a more thorough understanding of the disclosure herein. However, it will be apparent to one of ordinary skill in the art that the exemplary embodiments herein may be practiced without these specific details. In other instances, well-known features have not been described in detail to avoid unnecessarily complicating the description. As used herein, a length, a width, and height can each generally be described as lateral directions.

FIG. 1A depicts a cross-sectional side view of a LED-based lighting system 100 in accordance with one or more exemplary embodiments. Referring now to FIG. 1A, the LED-based lighting system 100 in this example is shown having a LED module 110 and a LED driver case 120. The LED module 110 includes a cavity 185 and surface for receiving and mounting one or more LEDs 152, such as chip-on-board LEDs, and another cavity 112 for receiving the LED driver case 120. The LEDs 152 can be mounted on an upper surface of the cavity 185, on the surface opposite the bottom of the housing 122 of the LED driver case 120 where the driver circuitry 124 is located.

In certain exemplary embodiments, the LED module 110 houses certain components, acts as a heat sink that receives heat from one or more components that generate heat, such as LEDs 152 and the LED driver, and dissipates the heat. The LED module 110 can be a single piece construction (e.g., die cast) or an assembly of multiple pieces. The LED module 110 includes a cavity 112 that is removably covered by a top plate member 114. The top plate member 114, when removed, allows access to the LED driver case 120 and/or other components positioned inside the cavity 112 of the LED module 110. The top plate member 114 may be coupled to the LED module 110 using one or more of a number of fastening methods, including but not limited to threaded couplings, a clamp, and threaded fasteners. The LED module 110 and/or the top plate member 114 can be made of one or more of a number of suitable materials (e.g., aluminum, alloy) that conducts and dissipates heat. One or more features (e.g., gaskets) may be used to provide a certain environment (e.g., dust free, moisture free) within the cavity 112 of the LED module 110 when the top plate member 114 is coupled to the LED module 110.

The LED module 110 also includes an aperture (hidden from view by a portion of the luminaire disconnect 130, but generally in the area designated as 111) that is sized and shaped to receive one or more connectors. In certain exemplary embodiments, the aperture 111 is positioned in the top plate member 114. For example, the aperture 111 in the top plate member 114 of the LED module 110 includes side walls that define a cavity for slidable insertion or snap-fit insertion of the luminaire disconnect 130. Alternatively, the aperture 111 is disposed in an outer wall 123 of the housing 122 or in a portion of the outer wall 123 and a portion of the top plate member 114. The exemplary aperture 111 can be defined by three generally vertical walls with an opening for insertion, removal, or simply manual access provided along an area which would have been the fourth vertical wall or from above or below the aperture 111. In this exemplary embodiment, tabs (not shown) or portions of the outer wall 123 can extend into the opening to reduce at least a portion of the lateral dimension of the opening and prevent the luminaire disconnect 130 from falling out of the aperture 111. Alternatively, the aperture 111 can be defined by four generally vertical walls, with insertion and removal provided from above or below the aperture 111.

In certain exemplary embodiments, the aperture 111 also receives another connector that mechanically mates with and electrically couples to the luminaire disconnect 130. The aperture 111 may be sized and/or positioned based on one or more of a number of factors, including but not limited to the size and shape of the luminaire disconnect 130, the location of the recessed area 126 of the LED driver case 120, the size and/or shape of the connector that couples to the luminaire disconnect 130, and the manner in which the luminaire disconnect 130 couples to the corresponding connector. For example, the aperture 111 is vertically aligned with the recessed area 126 (described below). As another example, the aperture 111 is shaped to conform to the top portion 145 of the luminaire disconnect 130. The exemplary aperture 111 can be larger than the top portion 145 of the luminaire disconnect 130.

In certain exemplary embodiments, the LED driver case 120 includes a housing 122, driver circuitry 124, a recessed area 126, and a luminaire disconnect 130. The housing 122 can be a single piece construction (e.g., die cast) or an assembly of multiple pieces. The housing 122 can be made of one or more of a number of suitable materials (e.g., plastic, aluminum, alloy) that absorbs and dissipates heat. The housing 122 is sized so that the housing 122 can be positioned within the cavity 112 of the LED module 110.

The driver circuitry 124 may be positioned within a cavity 132 of the housing 122. In certain exemplary embodiments, the driver circuitry 124 is a power supply for the LEDs (not shown). Specifically, the driver circuitry 124 receives power, processes the power, and delivers the processed power to the one or more LEDs 152. The driver circuitry 124 can also receive, process, and/or deliver control signals to the LED 152. The control signals can be received from the same wiring as that providing the source of power to the driver circuitry 124, other wiring, or by way of wireless signal, such as RF, with the inclusion of a receiver or transceiver (not shown). The driver circuitry 124 can be located inside the housing 122 or coupled to an exterior surface of the housing 122. The driver circuitry 124 can include one or more discrete components (e.g., transformer, resistor, relay), one or more hardware processors, or any suitable combination thereof.

The exemplary recessed area (partially hidden from view by a portion of the luminaire disconnect 130, but generally in the area designated as 126) of the LED driver case 120 traverses at least a portion of the housing 122 of the LED driver case 120 and can include an upper area (hidden from view by a portion of the luminaire disconnect 130, but generally in the area designated as 140) and a lower area 142. The upper area 140 and the lower area 142 can be adjacent, continuous portions of the recessed area 126. Alternatively, the upper area 140 and the lower area 142 can by physically separated by one or more features, such as a wall, a notch, and/or a slot.

The upper area 140 of the recessed area 126 has one or more of a number of shapes and features that allow the luminaire disconnect 130 to slidably couple with at least a portion of the upper area 140. Such features are described below with respect to FIG. 2A.

The exemplary luminaire disconnect 130 slidably couples with the upper area 140 of the recessed area 126 in one or more of any number of directions (e.g., vertically, horizontally). In certain exemplary embodiments, one of more of the features of the upper area 140 interlock with corresponding features of the luminaire disconnect 130 when the luminaire disconnect 130 is properly positioned within the upper area 140. The various features (e.g., top section 131, lateral dimension 127, bottom section 133, lateral dimension 129) of the upper area 140 can be positioned at the surface of the housing 122, inside of the housing 122, and/or outside of the housing 122. The upper area 140 may be positioned at any point on one or more surfaces of the housing 122. In certain exemplary embodiments, the upper area 140 is larger than the profile of the luminaire disconnect 130.

The lower area 142 of the recessed area 126 is receives one or more components when the luminaire disconnect 130 is coupled to the upper area 140. For example, as shown in FIG. 2C, the lower area 142 can receive one or more wires 210 that are connected to terminals in the luminaire disconnect 130 and run out the bottom portion 155 of the luminaire disconnect 130. In such a case, the wires 210 may travel through the lower area 142 to connect to one or more components within the cavity 112 of the LED module 110. The lower area 142 can include one or more features, including but not limited to a clip, a divider, and a channel. Such features can be used to direct and/or secure the wires 210.

In certain exemplary embodiments, the luminaire disconnect 130 provides power and/or control between one or more components (e.g., the driver circuitry) within the housing 122 and one or more devices outside of the housing 122. The luminaire disconnect 130 can be made of one or more of a number of materials, including but not limited to plastic, rubber, aluminum, and copper. The exemplary luminaire disconnect 130 includes an electrically non-conductive housing and one or more conductive terminal contacts disposed within the non-conductive housing. In the exemplary embodiment of FIG. 1B, two conductive terminal contacts are disposed within the non-conductive housing; however, one or more than two conductive contacts can be disposed within the non-conductive housing as desired. In certain exemplary embodiments, the non-conductive housing is constructed of plastic, such as by molding, while the terminal contacts are made of a conductive material, such as copper or aluminum, to assist in forming and maintaining an electrical coupling. In certain exemplary embodiments, the terminal contacts permit quick, push-in wire termination for the conductive portions of the wires 210 (FIG. 2C).

Figure 1B:
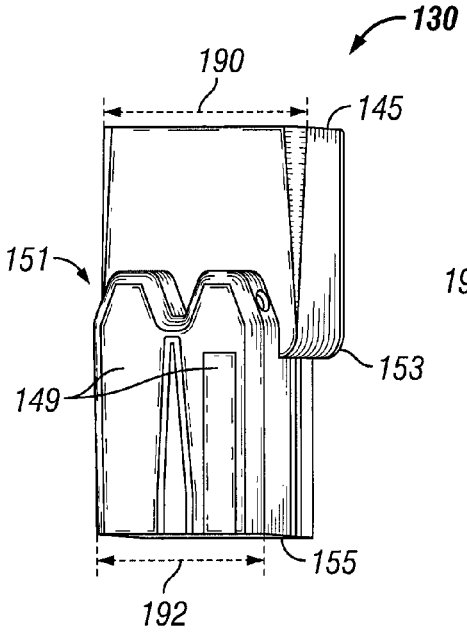
FIGS. 1B and 1C show various views of a luminaire disconnect used in accordance with one or more exemplary embodiments.
Figure 1C:
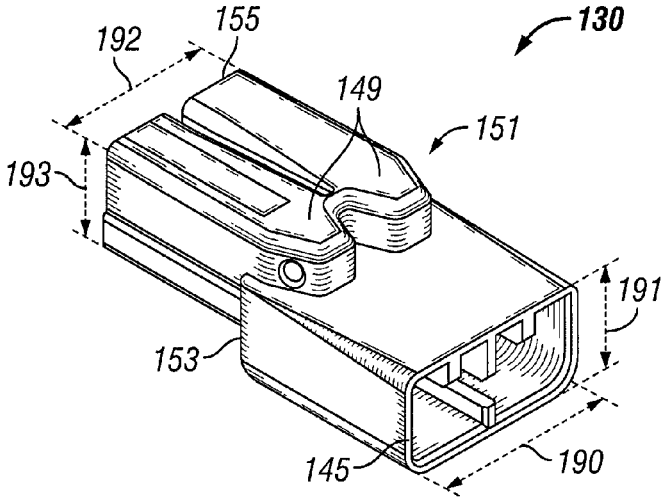

The exemplary luminaire disconnect 130, as shown in FIGS. 1B and 1C, has a top portion 145 and a bottom portion 155. The top portion 145 of the luminaire disconnect 130 includes shoulders 153 that extend laterally on one or more sides beyond the bottom portion 155. The shoulders 153 cause the top portion 145 to have a length 190 and a width 191. In addition, the bottom portion 155 includes one or more wire receiving portions 149 that extend laterally on at least one side (different than the side(s) where the top portion 145 extends laterally beyond the bottom portion 155) beyond the top portion 145. The wire receiving portions 149 cause the bottom portion 155 to have a length 192 and a width 193. A terminal connection (hidden from view but labeled as 151) is positioned inside the luminaire disconnect 130 and electrically couples electricity carrying devices (e.g., wires, connectors) in the top portion 145 and the bottom portion 155. In certain exemplary embodiments, the length 190 of the top portion 145 is greater than the length 192 of the bottom portion 155. Likewise, the width 191 of the top portion 145 can be less than the width 193 of the bottom portion 155.

In certain exemplary embodiments, the top portion 145 of the luminaire disconnect 130 is positioned within the top section 131 of the upper area 140. In addition, the bottom portion 155 of the luminaire disconnect 130 is positioned within the bottom section 133 of the upper area 140. In such a case, the lateral dimension 129 of the bottom section 133 is slightly greater than the length 192 of the bottom portion 155 of the luminaire disconnect 130. Further, the lateral dimension 127 of the top section 131 is slightly greater than the length 190 of the top portion 145 of the luminaire disconnect 130. In addition, a width of the top section 131 of the upper area 140 can be slightly greater than the width 191 of the top portion 145 of the luminaire disconnect 130, while the width of the bottom section 133 of the upper area 140 can be slightly greater than the width 193 of the bottom portion 155 of the luminaire disconnect 130

The top portion 145 of the luminaire disconnect 130 faces away from the upper area 140. As shown in FIG. 1A, the top portion 145 of the luminaire disconnect 130 is directed toward, and extends beyond, the top of the LED driver case 120. In certain exemplary embodiments, the top portion 145 of the luminaire disconnect 130 includes an aperture and the one or more terminals therein for engaging a corresponding mating connector (not shown) electrically and mechanically coupled to one or more devices outside the housing 122. In certain exemplary embodiments, the engagement is in a mating, overlapping relationship.

In certain exemplary embodiments, the luminaire disconnect 130 is slidably coupled to the upper area 140 in the housing 122 of the LED driver case 120. Alternatively, the luminaire disconnect 130 may be fixedly integrated with the housing 122 of the LED driver case 120. In certain exemplary embodiments, an overmold of the luminaire disconnect 130 is created by injecting the material of the luminaire disconnect 130 into the upper area 140 to form a stronger bond between the luminaire disconnect 130 and the housing 122.

The bottom portion 155 of the luminaire disconnect is positioned at the upper area 140 and/or inside the housing 122. The bottom portion 155 of the luminaire disconnect 130 provides an electrical connection to one or more components located within the cavity 112 of the housing 122. For example, the bottom portion 155 includes one or more apertures for receiving conductive portions of the wires 210 (FIG. 2C). The top portion 145 and the bottom portion 155 of the luminaire disconnect 130 can be male, female, and/or any other suitable configuration to which a corresponding connector can be mated outside of the housing 122 and/or inside of the housing 122.

Figure 2A:
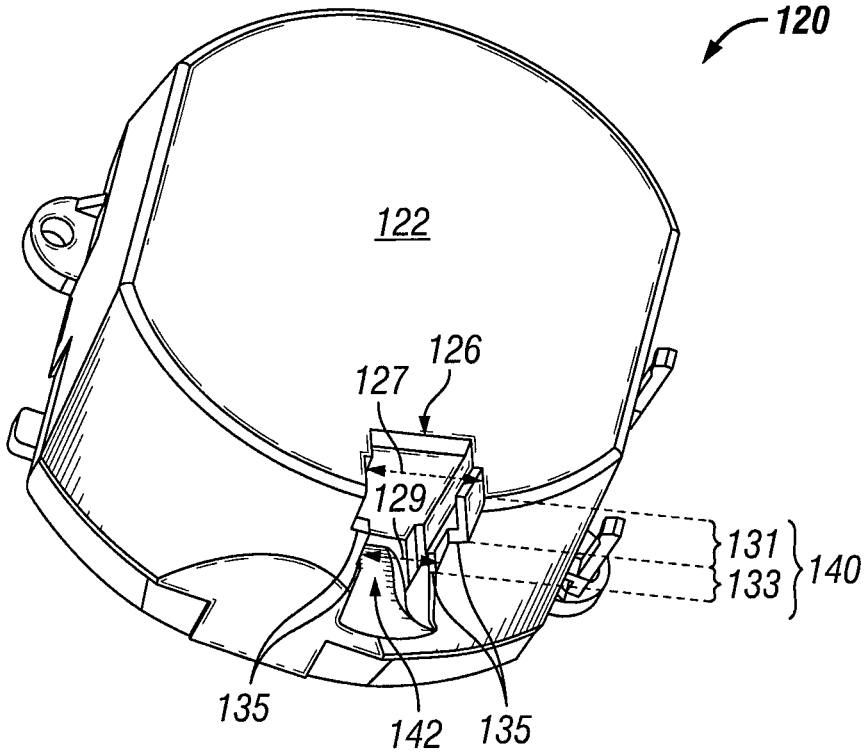
FIGS. 2A through 2C show various perspective views of a LED driver case in accordance with one or more exemplary embodiments.
Figure 2B:
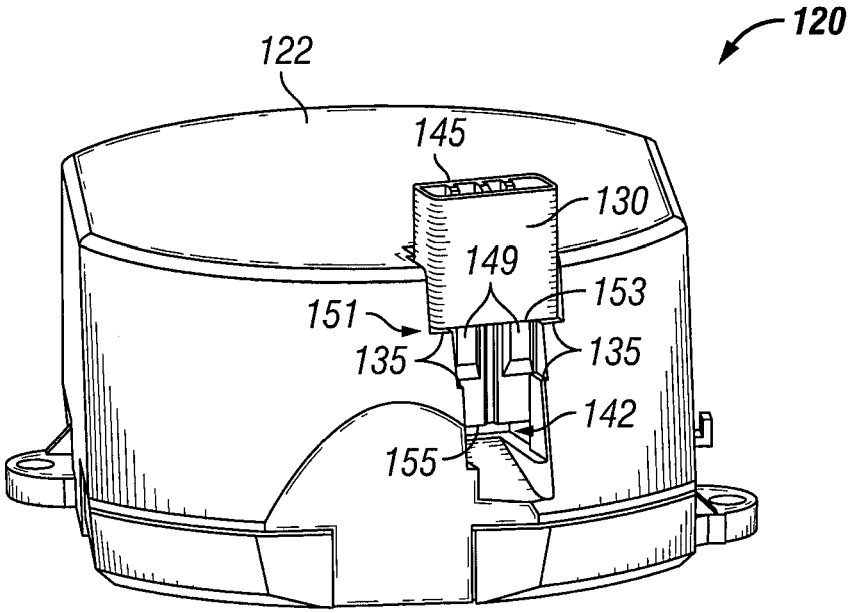
Figure 2C:
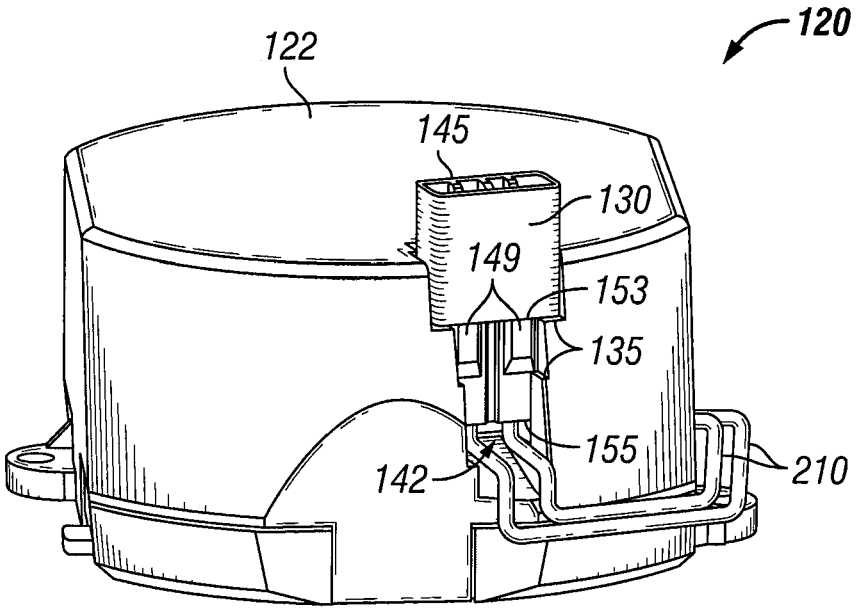

FIGS. 2A-2C show various perspective views of a LED driver case 120 in accordance with one or more exemplary embodiments. Referring now to FIGS. 1-2, the exemplary LED driver case 120 includes the housing 122 and the recessed area 126. The driver circuitry (not shown) is positioned inside of the housing 122. In certain exemplary embodiments, some or all of the components of the LED driver case 120 are located within the housing 122. Exemplary embodiments are not limited to the configuration shown in FIGS. 2A-2C and discussed herein.

FIG. 2A shows a top perspective view of the LED driver case 120 without the luminaire disconnect. In this example shown in FIG. 2A, the recessed area 126 is positioned at an upper corner of the housing 122 of the LED driver case 120. Specifically, the recessed area 126 is positioned between a side of the housing 122 and the top of the housing 122. The recessed area 126 can also be positioned at any other area on the surface of the housing 122. For example, the recessed area 126 can be positioned on a side of the housing 122, as shown below with respect to FIG. 3. As another example, the recessed area 126 can be positioned at the top of the housing 122.

The recessed area 126 shown in FIG. 2A includes one or more of a number of features. In certain exemplary embodiments, as shown in FIG. 2A, the upper area 140 of the recessed area 126 includes a top section 131 having a lateral dimension 127 and a bottom section 133 having a lateral dimension 129. In one exemplary embodiment, the lateral dimension 127 is greater than the lateral dimension 129. In an alternative embodiment, the lateral dimension 129 is greater than the lateral dimension 127. All or part of the upper area 140 can have one or more other dimensions, such as a width dimension that is perpendicular to the lateral dimension.

The features of the upper area 140 can be used to slidably couple the luminaire disconnect 130 and/or lock the luminaire disconnect 130 in place within the upper area 140. The recessed area 126 of FIG. 2A also includes the lower area 142, which can be used to allow one or more components such as the wires 210 shown in FIG. 2C, in addition to the luminaire disconnect 130, to traverse at least one surface of the housing 122. The lower area 142 can include one or more features, such as a ramp that rises at the outer surface of the housing 122, as shown in FIG. 2A.

FIG. 2B shows a top perspective view of the LED driver case 120 with the luminaire disconnect 130 coupled to the upper area 140 of the recessed area 126. FIG. 2C shows a top perspective view of the LED driver case 120 with the luminaire disconnect 130 coupled to the upper area 140 and with two wires 210 traversing the lower area 142 of the recessed area 126. In this case, the top portion 145 of the luminaire disconnect 130, when the luminaire disconnect 130 is coupled to the housing 122, extends beyond the top of the housing 122. Alternatively, the top portion 145 of the luminaire disconnect 130, when the luminaire disconnect 130 is coupled to the housing 122, may also be substantially flush with, or be positioned below, the top of the housing 122.

Similarly, as shown in FIG. 2B, a back portion of the luminaire disconnect 130, when the luminaire disconnect 130 is coupled to the upper area 140, may be substantially flush with a side wall of the housing 122. Alternatively, the back portion of the luminaire disconnect 130, when the luminaire disconnect 130 is coupled to the upper area 140, can also extend beyond or fall inside of a side wall of the housing 122. In any case, when the luminaire disconnect 130 is coupled to the upper area 140, the LED driver case 120 fits inside of the LED module (not shown) when the top plate (not shown) is coupled to the LED module.

Optionally, in certain exemplary embodiments, the recessed area 126 is shaped to include the lower area 142. The lower area 142 of the recessed area 126 can receive, while the luminaire disconnect 130 is coupled to the upper area 140, one or more additional components. The lower area 142 may allow one or more components to pass through a surface of the housing 120 regardless of whether the luminaire disconnect 130 is coupled to the upper area 140 of the housing 122. For example, as shown in FIG. 2C, a pair of wires 210 traverse the lower area 142 of the recessed area 126. Specifically, the pair of wires 210 runs from the terminal connection 151 inside the luminaire disconnect 130, through the wire receiving portions 149 of the bottom portion 155 of the luminaire disconnect 130, and through the lower area 142 to electrically couple to one or more components located inside of the LED driver case 120.

In such a case, the pair of wires 210 can be a single wire or multiple wires (e.g., two wires, three wires). Each wire 210 may be a single conductor or multiple conductors. Each wire 210 can be a bare conductor or a conductor coated with insulation. Each wire 210 can be made of one or more of a number of materials, including but not limited to copper, aluminum, rubber, and plastic. The wires 210 may be electrically coupled to one or more components within the cavity 112 of the LED module 110, the terminal connection 151, and/or one or more components within the cavity 132 of the housing 122.

Figure 3:
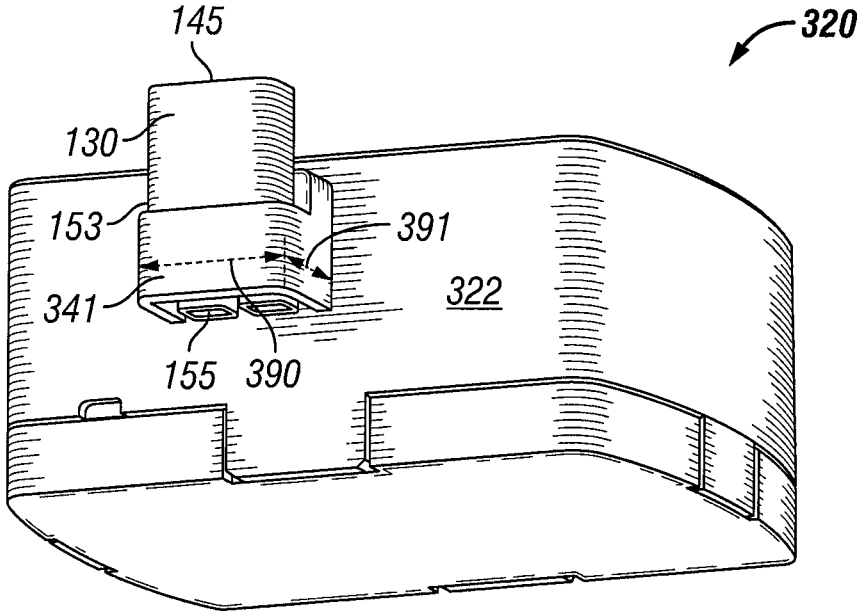
FIG. 3 shows a perspective view of an alternative LED driver case in accordance with one or more exemplary embodiments.

FIG. 3 shows a perspective view of an alternative exemplary LED driver case 320 in accordance with one or more exemplary embodiments. Referring now to FIGS. 1-3, the LED driver case 320 has a protrusion 341 into which the luminaire disconnect 130 is mechanically coupled. In certain exemplary embodiments, when the luminaire disconnect 130 is slidably coupled to the protrusion 341 mounted on an outer side of the housing 322, there is no recessed area in the housing 322. Alternatively, a recessed area can be positioned on a side of the housing 322 of the LED driver case 320, hidden from view by the protrusion 341 and the luminaire disconnect 330.

In this example, the top portion 145 of the luminaire disconnect 130 extends above a plane formed by the top of the housing 322. In certain exemplary embodiments, the protrusion 341 is positioned at any point on an outer surface vertical wall of the housing 322. As a result, the height of the top portion 145 of the luminaire disconnect 130 can extend any distance above or below (or at) the plane formed by the top of the housing 322.

In certain exemplary embodiments, the protrusion 341 includes four walls defining an aperture having a shape and size to slidably receive a portion of the luminaire disconnect 130 therein and therethrough to fixedly hold the disconnect 130 in place. For example, as shown in FIG. 3, the protrusion 341 includes a length 390 and a width 391. In such a case, the length 390 and width 391 of the protrusion 341 may be greater than the length 192 and/or width 193 of the bottom portion 155 of the luminaire disconnect 130, but less than the length 190 and/or width 191 of the top portion 145 of the luminaire disconnect 130. The protrusion 341 may be positioned so that the luminaire disconnect 130 slidably couples to the protrusion 341 vertically (as shown in FIG. 3), horizontally, or in any other suitable direction.

In certain exemplary embodiments, the protrusion 341 includes more than one open portions (in this example, top and bottom) to receive not only the luminaire disconnect 130, but also one or more other components (e.g., a wire, a connector) that traverses a bottom feature (not shown) in the aperture. For example, for the configuration shown in FIG. 3, a connector can electrically and mechanically couple to the top portion 145 of the luminaire disconnect 130, while one or more wires can electrically and mechanically couple to the bottom portion 155 of the luminaire disconnect 130. In certain exemplary embodiments, the inner surface of the protrusion 341 includes one or more features, similar to the side features described above with respect to FIG. 2A, to slidably couple the luminaire disconnect 130 and/or fixedly hold the luminaire disconnect 130 in place.

Figure 4A:
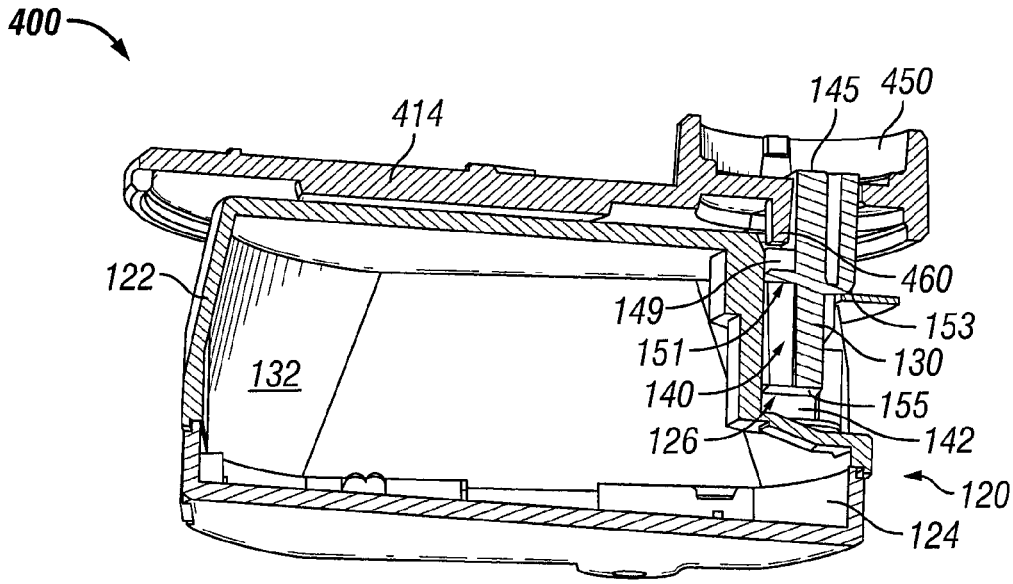
FIGS. 4A and 4B show a LED-based lighting system with a retaining feature used in conjunction with a LED driver case in accordance with one or more exemplary embodiments.
Figure 4B:
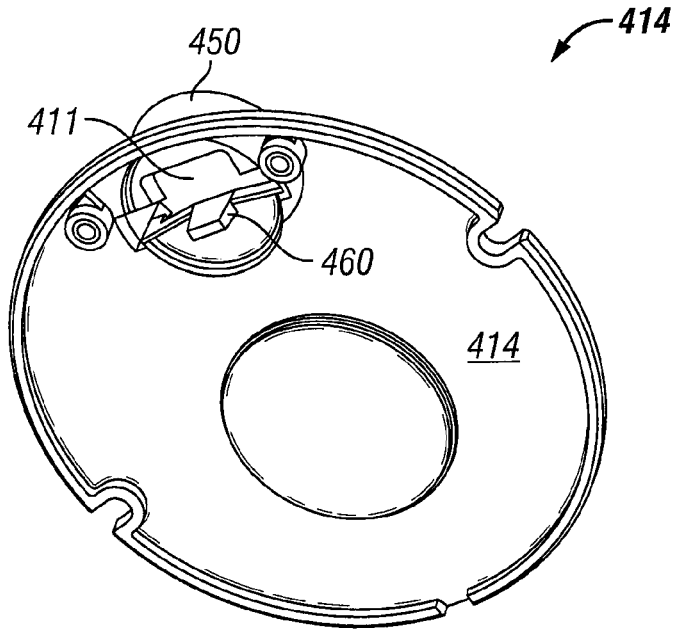

FIGS. 4A and 4B show a LED-based lighting system 400 with a securing mechanism 460 used in conjunction with a LED driver case 120 in accordance with one or more exemplary embodiments. Specifically, FIG. 4A shows a cross-sectional side view of the LED-based lighting system 400, and FIG. 4B shows a perspective bottom view of the exemplary top plate 414. Referring now to FIGS. 1-4, the LED-based lighting system 400 includes a housing 122, driver circuitry 124, a recessed area (partially hidden from view by the luminaire disconnect 130, but generally in the area designated as 126), and a luminaire disconnect 130 of a LED driver case 120. The recessed area 126 includes an upper area (fully hidden from view by the luminaire disconnect 130, but generally in the area designated as 140) and a lower area 142. The lower area 142 is located below the luminaire disconnect 130 when the luminaire disconnect 130 is coupled to the upper area 140. Each of these components of the LED driver case 120 are substantially similar to the corresponding components described above with respect to FIGS. 1-3.

The LED-based lighting system 400 also includes a top plate member 414, which is substantially similar to the top plate member 114 described above with respect to FIG. 1. In addition, the top plate member 414 includes a few additional features. Specifically, the top plate member 414 includes a connection channel 450 positioned on the top surface of the top plate member 414. In certain exemplary embodiments, the connection channel 450 creates a designated area in which one or more electrical and/or mechanical connections are made to the luminaire disconnect 130. For example, as shown in FIGS. 4A and 4B, the connection channel 450 may surround and define the aperture 411 in the top plate member 414.

The connection channel 450 may have one of a number of configurations. For example, as shown in FIG. 4A, the connection channel 450 has a wall formed in a circular shape, where the wall extends upward away from the top surface of the top plate member 414 and surrounds the aperture 411 in the top plate member 414. In this example, the top portion 145 of the luminaire disconnect 130 is positioned approximately flush with the top surface of the top plate member 414 inside of the wall of the connection channel 450.

In addition, the exemplary top plate member 414 includes a retaining feature 460 that limits the movement of the luminaire disconnect 130 in one or more directions when the luminaire disconnect 130 is coupled to the upper area 140 of the housing 122. The retaining feature 460 may be one or more protrusions that extend away from the bottom surface of the top plate member 414. In this case, the retaining feature 460 is a tab-shaped feature that extends orthogonally or substantially orthogonally away from the bottom surface of the top plate member 414 toward the luminaire disconnect 130. When the top plate member 414 is coupled to the LED module (not shown), the retaining feature 460 contacts or approximately contacts one or both of a vertical and horizontal surface portion of the luminaire disconnect 130. In such a position, the retaining feature 460 prevents and/or limits vertical movement of the luminaire disconnect 130 when the luminaire disconnect 130 is slidably coupled (in the vertical direction) to the upper area 140 in the housing 122. The exemplary retaining feature 460 can be positioned in any manner suitable to prevent and/or limit the vertical and/or lateral movement of the luminaire disconnect 130 when the luminiare disconnect is coupled to the upper area 140 and when the top plate member 414 is coupled to the LED module 110.

In certain exemplary embodiments, the connection channel 450 and/or the retaining feature 460 are made from one or more of a number of materials, including but not limited to metal, plastic, ceramic, and rubber. Further, the connection channel 450 and/or the retaining feature 460 may be a single integrated piece with the top plate member 414 or a separate piece that is coupled to the top plate member 414. In the latter case, the connection channel 450 and/or the retaining feature 460 are coupled to the top plate member 414 using one or more of a number of fastening methods, including but not limited to welding, riveting, mating threads, compression fittings, and fastening devices (e.g., screws, bolts).

Figure 5A:
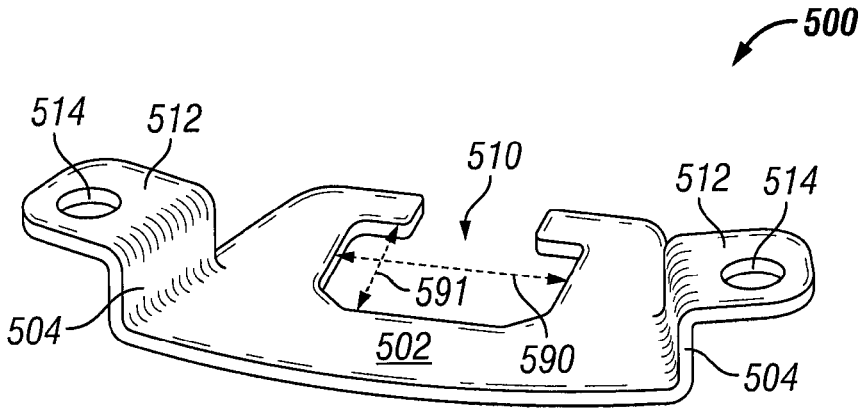
FIGS. 5A through 5D show various views of an alternative retaining feature used in conjunction with a LED-based lighting system in accordance with one or more exemplary embodiments.
Figure 5B:
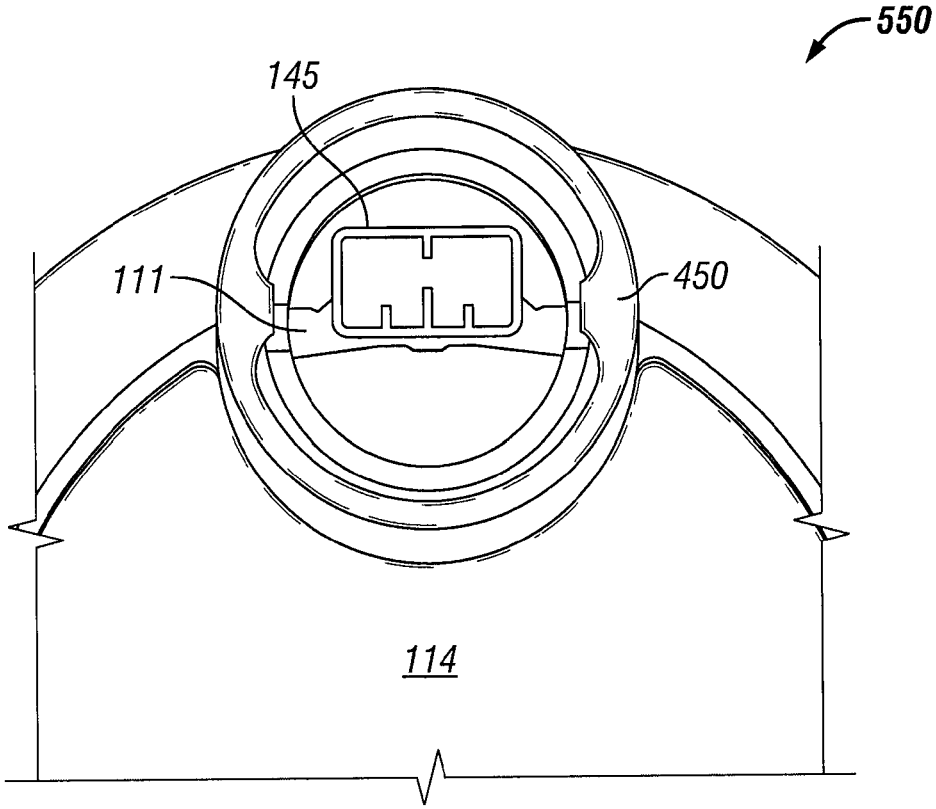
Figure 5C:
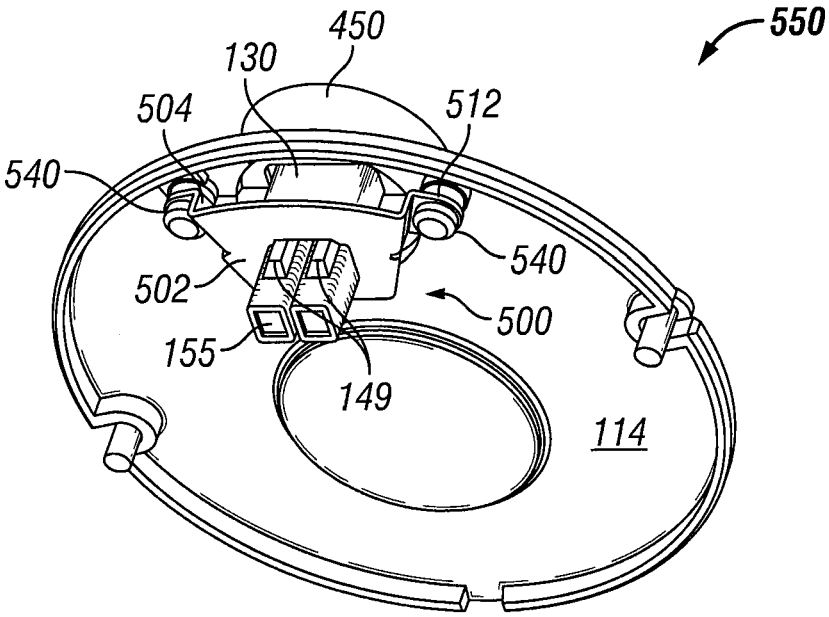
Figure 5D:
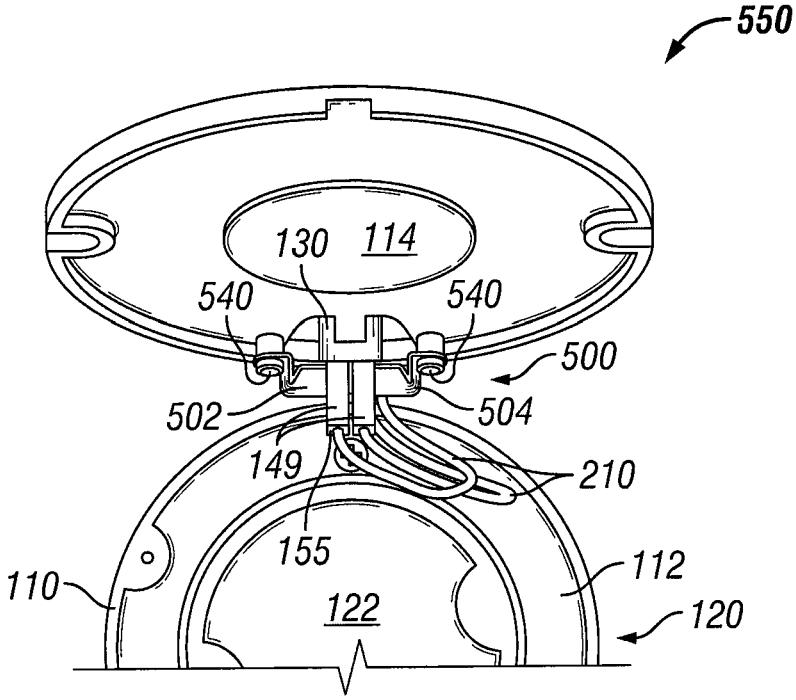

FIGS. 5A through 5D show various views of an alternative retaining feature 500 used in conjunction with a LED-based lighting system 550 in accordance with one or more exemplary embodiments. Specifically, FIG. 5A shows a top perspective view of an alternative retaining feature 500. FIGS. 5B and 5C show the retaining feature 500 coupled to the top plate member 114. FIG. 5D shows a LED-based lighting system 550 that includes the retaining feature 500.

Referring now to FIGS. 1-5D, FIG. 5A shows the retaining feature 500. The retaining feature 500 includes a base portion 502 that includes a shaped aperture 510 that extends therethrough and to one of the sides of the base portion 502. In this example, the shaped aperture 510 extends to the far side of the base portion 502. The shape of the shaped aperture 510 may be one of a number of shapes. In one exemplary embodiment, the shape of the shaped aperture 510 is substantially similar to at least a portion of a horizontal profile of a section of the luminaire disconnect 130. As shown in FIG. 5A, the exemplary aperture 510 has a length 590 and a width 591.

At one or both ends of the retaining feature 500 is a top portion 512, which is elevated from the base portion 502 by a side portion 504. In certain exemplary embodiments, the top portion 512 is substantially parallel to the base portion 502. Alternatively, the top portion 512 is askew from the base portion 502. Each exemplary side portion 504 can extend orthogonally or substantially orthogonally up from the base portion 502 to the top portion 512. Alternatively, a side portion can be coplanar with the base portion 502.

In certain exemplary embodiments, each top portion 512 includes a mounting aperture 514 disposed therethrough. The mounting aperture 514 receives a fastening device 540 (e.g., bolt, screw, rivet) that traverses the top portion 512 and couples the top portion 512 to a bottom surface of the top plate member 114. Such a fastening device 540 may also traverse the top plate member 114 or traverse only a portion of the top plate member 114. In certain exemplary embodiments, the top portion 512 is fastened to the bottom surface of the top plate member 114 using one or more of a number of other fastening methods, including but not limited to epoxy, welding, and snap fittings. In such a case, the top portion 512 may not include a mounting aperture 514. In this example, as shown in FIGS. 5C and 5D, a rivet is used to traverse the mounting aperture 514 in the top portion 512 as well as a portion of the top plate member 114.

The top portion 512, side portion 504, and/or the base portion 502 of the retaining feature 500 can be a single integrated piece or separate pieces that are mechanically coupled. In the latter case, one or more of the components of the retaining feature 500 can be coupled using one or more of a number of fastening methods, including but not limited to welding, epoxy, mating threads, compression fittings, and rivets. The components of the retaining feature 500 can be made from one or more of a number of materials, including but not limited to plastic, rubber, and metal.

The top view of the LED-based lighting system 550 in FIG. 5B shows that the top portion 145 of the luminaire disconnect 130 is substantially flush with the top surface of the top plate member 114. As shown in FIG. 5C, the luminaire disconnect 130 is being held in place, at least in part, by the retaining feature 500. The shape of the aperture 510 of the retaining feature 500 is substantially the same as the shape of the bottom portion 155 of the luminaire disconnect 130. In other words, the length 590 of the aperture 510 is slightly larger than the length 192 of the bottom portion 155 of the luminaire disconnect 130, and the width 591 of the aperture 510 is slightly larger than the width 193 of the bottom portion 155 of the luminaire disconnect 130. Because the shoulders 153 of the luminaire disconnect 130 causes the top portion 145 of the luminaire disconnect 130 to have either or both of the length 190 and the width 191 to be greater than the length 192 and/or the width 193 of the bottom portion 155 of the luminaire disconnect 130, the bottom portion 155 slides though the aperture 510 until the shoulders 153 contact the top side of the base 502 and thereby prevent the luminaire disconnect 130 from going any further through.

In certain exemplary embodiments, the retaining feature 500 prevents or limits the movement of the luminaire disconnect 130 in one or more of a number of directions. In this example, the retaining feature 500 prevents or limits substantially all movement of the luminaire disconnect 130 except for an upward movement. In certain exemplary embodiments, the base 502 includes one or more features (e.g., a protrusion) that prevents or limits the luminaire disconnect 130 from moving in one or more additional directions. For example, a protrusion (not shown) along the aperture 510 may lock into a protrusion receiver of the luminaire disconnect 130.

The retaining feature 500 may have one or more of a number of different shapes from the shape shown herein. Further, the wires 210 that extend beyond the bottom portion 155 of the luminaire disconnect 130 into the cavity 112 of the LED module 110 may be the same as, or different wires than, the wires 210 described above with respect to FIG. 2C.

Figure 6A:
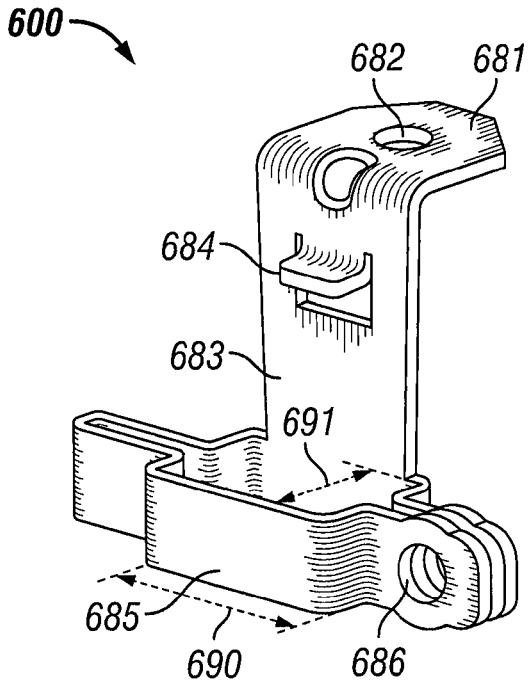
FIGS. 6A through 6D show various views of yet another retaining feature used in conjunction with a LED-based lighting system in accordance with one or more exemplary embodiments.
Figure 6B:
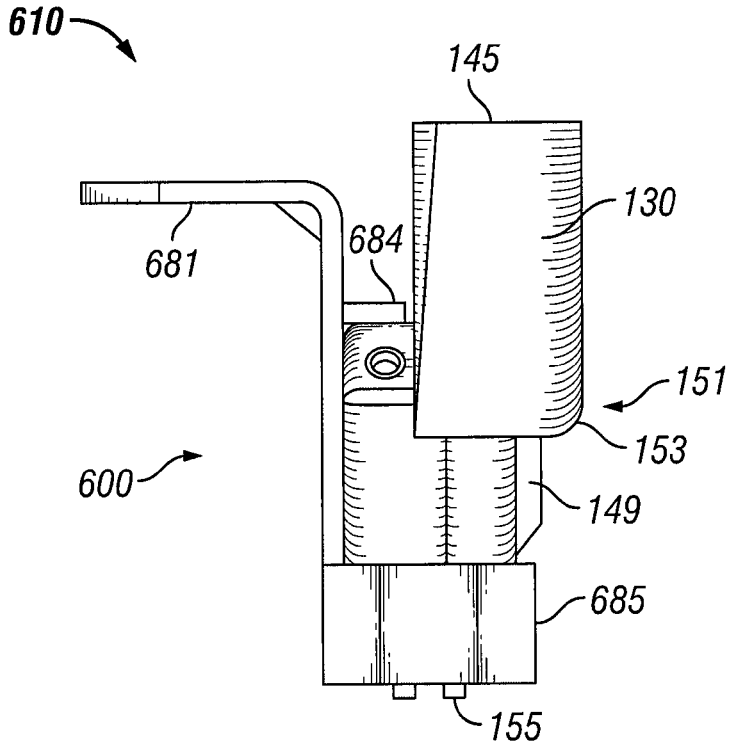
Figure 6C:
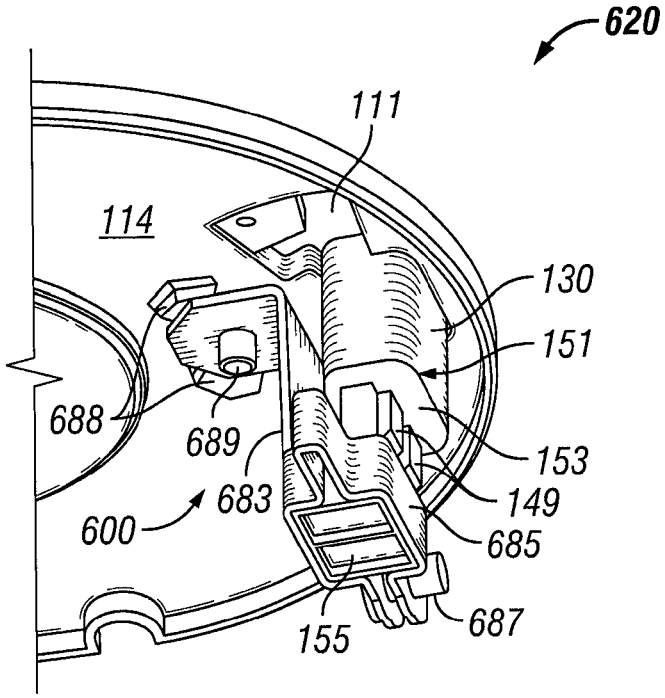
Figure 6D:
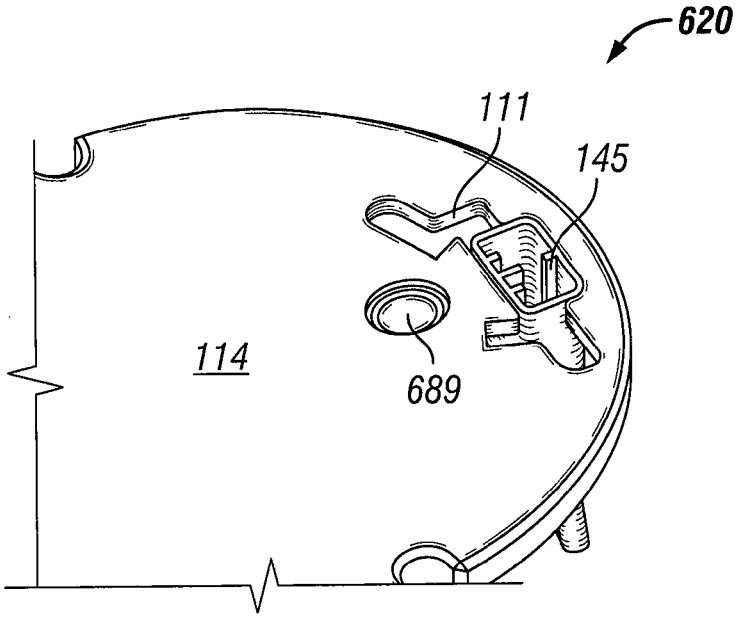

FIGS. 6A through 6D show various views of yet another retaining feature 600 used in conjunction with a LED-based lighting system 620 in accordance with one or more exemplary embodiments. Specifically, FIG. 6A shows a perspective view of the exemplary retaining feature 600. FIG. 6B shows a side view of a system 610 that includes the retaining feature 600 coupled with a luminaire disconnect 130. FIGS. 6C and 6D show perspective views of the LED-based lighting system 620 using the retaining feature 600.

Referring now to FIGS. 1-6D, the exemplary retaining feature 600 includes a top portion 681 that is coupled at an angle to a back member portion 683. The angle may be orthogonal or any other suitable angle. The exemplary top portion 681 has a flat planar surface for coupling the retaining feature 600 to the underside of the top plate member 114. In certain exemplary embodiments, the top portion 681 includes a mounting aperture 682, through which a fastening device 689 (e.g., a screw, pin, rivet, bolt) may pass. Such a fastening device 689 may also traverse the top plate member 114 or traverse only a portion of the top plate member 114. In certain exemplary embodiments, the top portion 681 is fastened to the bottom surface of the top plate member 114 using one or more of a number of other fastening methods, including but not limited to epoxy, welding, and snap fittings. In such a case, the top portion 681 may not include a mounting aperture 682. In this example, as shown in FIGS. 6C and 6D, a pin is the fastening device 689 that traverses the mounting aperture 682 in the top portion 681 as well as most of the top plate member 114.

In certain exemplary embodiments, the back member portion 683 extends vertically downward from the top portion 681 and includes a fastening clip 685 that slidably receives and secures the luminaire disconnect 130. The aperture 621 formed by the fastening clip 685 has a length 690 and a width 691. The length 690 and/or the width 691 of the aperture 621 defined by the inner walls of the fastening clip 685 may be adjustable to accommodate different sizes of luminaire disconnect 130. For example, the length of the back member portion 683, the length 690 of the aperture 621, and/or the width 691 of the aperture 621 may be adjusted to accommodate a particular luminaire disconnect 130 so that the top portion 145 of the luminaire disconnect 130 is aligned in a particular position relative to the top plate member 114 and so that the shoulder portion 153 properly engages a top edge of the fastening clip 685. In this example, the top portion 145 of the luminaire disconnect 130 is substantially flush with the top surface of the top plate member 114.

In certain exemplary embodiments, the fastening clip 685 is secured over the luminaire disconnect 130 using a fastening clip aperture 686 located proximate to the fastening clip 685. The fastening clip aperture 686 may be positioned on one or more sides of the fastening clip 685. The fastening clip 685 may be configured to apply pressure to the luminaire disconnect 130 to reduce and/or eliminate movement in one or more of a number of directions (e.g., lateral, downward vertical, transverse motion) of the luminaire disconnect 130.

The luminaire disconnect 130 can further be secured to the retaining feature 600 using a tab 684 that protrudes orthogonally or substantially orthogonally out in a horizontal direction from the back member portion 683 of the retaining feature 600. The tab 684 may be configured to couple (e.g., sit atop a top surface, be positioned inside a slot within) to the luminaire disconnect 130 to control the extent to which the top portion 145 of the luminaire disconnect 130 extends. The tab 684 may also be configured to reduce and/or eliminate upward vertical motion of the luminaire disconnect 130.

In one or more exemplary embodiments, the retaining feature 600 is a single piece made of a single material (e.g., plastic, aluminum). Alternatively, the retaining feature 600 can be made of several components and/or several different materials (e.g., metal, rubber, plastic). In such a case, the various components of the retaining feature 600 can be coupled using one or more of a number of methods, including but not limited to welding, epoxy, and threaded fasteners.

The retaining feature 600 may be used to stabilize the luminaire disconnect 130 by eliminating vertical, horizontal, and/or transverse motion of the luminaire disconnect 130. Further, the retaining feature 600 allows the luminaire disconnect 130 to be mounted to a surface so that a corresponding connector can couple and/or decouple with the luminaire disconnect 130 directly through the aperture in the surface of top plate member 114.

FIGS. 6C and 6D show perspective views of a portion of a LED-based lighting system 620 using the retaining feature 600. Specifically, a retaining feature 600 is coupled to the underside (bottom surface) of a top plate member 114. The fastening device 689 protrudes through the mounting aperture 682 in the top portion 681 of the retaining feature 600 to secure the retaining feature 600 to the top plate member 114. The retaining feature 600 is also held in place by two guides 688 that are coupled to the bottom surface of the top plate member 114.

The fastening clip 685 couples to at least a part (in this example, around the bottom portion 155) of the luminaire disconnect 130. The fastening clip 685 is secured in a closed position using a fastener 687 that traverses the fastening clip aperture 686. The fastener 687 may be any type of fastening device, including but not limited to a nut and bolt combination, a threaded screw that complements threads in the fastening clip aperture, a rivet screw, and a pin welded in place. The tab 684 abuts against a portion of the luminaire disconnect 130 to control the height of the luminaire disconnect 130 relative to the top plate member 114.

In certain exemplary embodiments, the retaining feature 600 is positioned in more than one location relative to the aperture 111 in the top plate member 114. In other words, the bracket guides 688 may be slidable and/or removable along the bottom surface of the top plate member 114 so that the retaining feature 600 can secure more than one different size/type of luminaire disconnect and have the particular luminaire disconnect align with the aperture 111 in the top plate member 114. In addition, or alternatively, the top portion 681 of the retaining feature 600 can have multiple apertures through which the fastening device 689 traverses to couple the retaining feature 600 to the top plate member 114.

While the exemplary embodiments of the retaining features described herein are coupled to the bottom surface of a top plate member 114, the retaining features can also, or in the alternative, be coupled to other surfaces inside of, outside of, and/or adjacent to one or more components of the LED-based lighting system.

Using exemplary embodiments described herein, a LED driver case can be adapted to include a luminaire disconnect that is used more efficiently and/or more reliably with a LED-based lighting system. The exemplary LED driver case can be flexible to receive one or more of a number of luminaire disconnects, each having varying shapes and sizes. One or more of a number of retaining features can be used with one or more exemplary embodiments to properly secure and position a luminaire disconnect of a LED driver case.

Further, exemplary embodiments can improve the manufacturing of a LED-based lighting system by reducing the amount of fasteners used to build the LED-based lighting system. As a result, manufacturing time is reduced. Further, the use of certain tools for assembly of the LED-based lighting system can be reduced or eliminated. In addition, safety with respect to manufacturing, installing, and maintaining the LED-based lighting system is improved. In some cases, using certain exemplary embodiments, there are no sheet metal edges.

Although embodiments described herein are made with reference to exemplary embodiments, it should be appreciated by those skilled in the art that various modifications are well within the scope and spirit of this disclosure. Those skilled in the art will appreciate that the exemplary embodiments described herein are not limited to any specifically discussed application and that the embodiments described herein are illustrative and not restrictive. From the description of the exemplary embodiments, equivalents of the elements shown therein will suggest themselves to those skilled in the art, and ways of constructing other embodiments using the present disclosure will suggest themselves to practitioners of the art. Therefore, the scope of the exemplary embodiments is not limited herein.

We claim:

1. A light-emitting diode (LED) driver case, comprising:
- a housing comprising a base member and at least one wall defining a cavity;
- LED driver circuitry positioned within the cavity of the housing;
- a recessed area formed within the housing; and
- a luminaire disconnect slidably coupled to the recessed area and electrically coupled to the LED driver circuitry, the luminaire disconnect comprising:
  - a non-conductive outer housing; and
  - at least one conductive electrical contact disposed at least partially within the non-conductive outer housing,
  - wherein the LED driver circuitry is electrically coupled to the at least one conductive electrical contact in the luminaire disconnect, and
  - wherein the luminaire disconnect is configured to receive power from a power source, wherein the power is transmitted through the at least one conductive electrical contact to the LED driver circuitry.

2. The LED driver case of claim 1, further comprising a wire comprising a first end and a distal second end, the first end coupled to the at least one conductive electrical contact and the second end coupled to the LED driver circuitry, wherein a portion of the wire extends through a portion of the recessed area and outside the housing.

3. The LED driver case of claim 1, wherein the luminaire disconnect comprises a first portion having a first lateral dimension and a second portion have a second lateral dimension greater than the first lateral dimension,
- wherein the recessed area comprises a third portion that has a third lateral dimension and a fourth portion that has a fourth lateral dimension greater than the third lateral dimension, and
- wherein the third lateral dimension is greater than the first lateral dimension but less than the second lateral dimension.

4. The LED driver case of claim 1, wherein the luminaire disconnect is removable from the recessed area.

5. The LED driver case of claim 1, wherein the recessed area is disposed in an external ceiling wall of the housing, wherein the external ceiling wall is removably coupled to the at least one wall of the housing.

6. The LED driver case of claim 1, wherein the recessed area comprises:
- a pair of vertically disposed side walls, each side wall comprising a first longitudinal edge and a second, opposing longitudinal edge;
- a vertically disposed back wall coupled to each of the pair of vertically disposed side walls along the first longitudinal edge;
- at least one tab member extending substantially orthogonally out from the second longitudinal edge of one of the pair of vertically disposed side walls;
- wherein the tab member prevents the luminaire disconnect from moving laterally away from the vertically disposed back wall when the luminaire disconnect is disposed at least partially within the recessed area.

7. The LED driver case of claim 1, further comprising a top plate member removably coupled to the housing and comprising an aperture disposed through the top plate member, wherein the aperture in the top plate member and the recessed area are vertically aligned.

8. A light-emitting diode (LED) driver case, comprising:
a housing comprising a base member and at least one wall defining a cavity;
LED driver circuitry positioned within the cavity of the housing;
a protrusion disposed upon the at least one wall of the housing; and
a luminaire disconnect slidably coupled to the protrusion and electrically coupled to the LED driver circuitry, the luminaire disconnect comprising:
a non-conductive outer housing; and
at least one conductive electrical contact disposed at least partially within the non-conductive outer housing,
wherein the LED driver circuitry is electrically coupled to the at least one conductive electrical contact in the luminaire disconnect, and
wherein the luminaire disconnect is configured to receive power from a power source, wherein the power is transmitted through the at least one conductive electrical contact to the LED driver circuitry.

9. A light-emitting diode (LED) driver case, comprising:
a housing comprising:
a base member;
at least one vertical wall coupled to the base member; and
a top member comprising a top surface and an opposing bottom surface, the top member being removably coupled to the at least one vertical wall, wherein the base member, the at least one vertical wall, and the top member define a cavity;
a LED driver disposed within the cavity of the housing;
an aperture disposed through the top plate member;
a disconnect mount coupled to the bottom surface of the top member and comprising a receiving aperture having a first dimension; and
a luminaire disconnect slidably coupled to the disconnect mount and disposed at least partially through the receiving aperture, the luminaire disconnect comprising:
a non-conductive outer housing have a first lateral dimension and a second lateral dimension greater than the first lateral dimension; and
at least one conductive electrical contact disposed at least partially within the non-conductive outer housing,
wherein the first dimension of the receiving aperture is greater than the first lateral dimension but less than the second lateral dimension, wherein the receiving aperture slidably receives a portion of the luminaire disconnect.

10. The LED driver case of claim 9, further comprising a wire comprising a first end and a distal second end, the first end coupled to the at least one electrical contact and the second end electrically coupled to the LED driver.

11. The LED driver case of claim 9, wherein the aperture in the top plate member and the receiving aperture are vertically aligned.

12. The LED driver case of claim 9, wherein a volume of the receiving aperture is adjustable.

13. The LED driver case of claim 9, wherein the disconnect mount further comprises:
a base member comprising a planar surface disposed substantially parallel to the base member of the housing, the base member comprising a first end and an opposing second end;
a first mounting tab coupled to the first end and vertically offset from the base member; and
a second mounting tab coupled to the second end and vertically offset from the base member, the first and second mounting tabs being disposed adjacent to the bottom surface of the top member,
wherein the receiving aperture is disposed through the base member.

14. The LED driver case of claim 9, wherein the disconnect mount further comprises:
a mounting tab disposed against the bottom surface of the top member;
a back member having a first end and a distal second end, the first end of the back member coupled to the mounting tab, wherein the back member extends orthogonally from the mounting tab; and
a fastening clip coupled to the second end of the back member, wherein the fastening clip comprises a plurality of walls defining the receiving aperture.

15. The LED driver case of claim 14, wherein the disconnect mount further comprises a tab protrusion extending orthogonally out from a surface of the back member and disposed between the first end and the fastening clip.

16. The LED driver case of claim 14, wherein the bottom surface of the top member comprises at least one bracket guide extending out from the bottom surface and configured to abut at least a portion of the luminaire disconnect.

17. A luminaire comprising:
a light emitting diode (LED) module comprising:
an exterior wall comprising an inner surface and an opposing outer surface;
a base member disposed upon and extending between the inner surface of the exterior wall and comprising a top surface and an opposing bottom surface;
a first cavity defined by the exterior wall and the top surface of the base member;
a second cavity defined by the exterior wall and the bottom surface of the base member; and
a top wall member removably coupled to the exterior wall and enclosing at least a portion of the first cavity;
a LED driver disposed within the first cavity;
at least one LED disposed within the second cavity, thermally coupled to the bottom surface of the base member, and electrically coupled to the LED driver;
a recessed housing formed within at least one of the walls of the LED module; and
a luminaire disconnect slidably coupled to the recessed housing and electrically coupled to the LED driver, the luminaire disconnect comprising:
a non-conductive outer housing; and
at least one conductive electrical contact disposed at least partially within the non-conductive housing.

18. The luminaire of claim 17, wherein the top wall member, the recessed housing, and the luminaire disconnect are integrally formed.

19. The luminaire of claim 17, wherein the luminaire disconnect is removably coupled to the recessed housing.

20. The luminaire of claim 17, wherein the luminaire disconnect comprises a first portion having a first lateral dimension and a second portion having a second lateral dimension greater than the first lateral dimension,
wherein the recessed housing comprises a third portion that has a third lateral dimension and a fourth portion that has a fourth lateral dimension greater than the third lateral dimension, and
wherein the third lateral dimension is greater than the first lateral dimension but less than the second lateral dimension.

* * * * *